US008282740B2

(12) United States Patent
Gohl

(10) Patent No.: US 8,282,740 B2
(45) Date of Patent: Oct. 9, 2012

(54) APPARATUS, SYSTEMS AND METHODS FOR REMOVING DEBRIS FROM A SURFACE

(75) Inventor: Mark Gohl, Yorkshire (GB)

(73) Assignee: Eldon Technology Limited, Keighley (GB)

( * ) Notice: Subject to any disclaimer, the term of this patent is extended or adjusted under 35 U.S.C. 154(b) by 416 days.

(21) Appl. No.: 12/691,492

(22) Filed: Jan. 21, 2010

(65) Prior Publication Data

US 2011/0174332 A1 Jul. 21, 2011

(51) Int. Cl.
*B08B 3/12* (2006.01)

(52) U.S. Cl. ..... 134/1; 134/6; 134/16; 134/42; 15/3; 15/89; 15/91; 15/92; 15/246

(58) Field of Classification Search ..... 15/3, 89, 15/91, 92, 94, 246; 134/1, 6, 16, 42
See application file for complete search history.

(56) References Cited

U.S. PATENT DOCUMENTS 5,786,563 A 7/1998 Tiburzi
2009/0302708 A1 12/2009 Takahashi

*Primary Examiner* — Bibi Carrillo
(74) *Attorney, Agent, or Firm* — Lowe Graham Jones PLLC

(57) ABSTRACT

Exemplary surface debris removal systems and methods are operable to remove debris from a signal transmitting/receiving surface. An embodiment provides power to, and then removes power from, a conductive memory wire that is secured to a moveable portion of a two-position snap spring. In response to providing the power to the conductive memory wire, a length of the conductive memory wire decreases so that the moveable portion of the two-position snap spring is pulled from an extended position to a retracted position. When power is removed from the conductive memory wire, the moveable portion of the two-position snap spring moves from the retracted position to the extended position. In response to the moving of the moveable portion of the two-position snap spring from the retracted position to the extended position, an energy is generated and transferred to the surface that dislodges the debris from the surface.

13 Claims, 4 Drawing Sheets

APPARATUS, SYSTEMS AND METHODS FOR REMOVING DEBRIS FROM A SURFACE

BACKGROUND

Optical and electronic devices may accumulate debris that interferes with the intended purpose of the devices. Debris may include snow, ice, dirt, dust, or other matter. Such debris may accumulate on a signal-receiving or signal-transmitting surface that is exposed to an ambient environment. For example, a satellite antenna, also referred to as a satellite dish, may accumulate snow that blocks or interferes with the reception or transmission of communication signals. Debris accumulating on the surface of a mirror may degrade reflectivity of the mirror. Similarly, debris on a lens surface may degrade and/or distort transmissivity of the lens. Accordingly, when performance of the device is degraded due to debris accumulation on an exposed surface, the surface will require removal of the debris. In some situations, the surface of the device may be periodically cleaned so as to reliably maintain the performance characteristics of the device.

Debris may be removed manually from the surface of the device. However, there may be an undesirable time delay while service personnel are dispatched to perform the manual task of debris removal. And, the attendant labor charges may be relatively expensive.

In other situations, the debris may be removed from the surface of the device using a debris-removing device. However, such debris removal devices require a source of power. Accordingly, the initial cost of the electronic debris removal device, the cost of the power source, and the associated operating costs of such electronic debris removal devices and their associated power source may be relatively expensive.

Accordingly, there is a need in the arts for improved surface debris removal devices and methods.

SUMMARY

Systems and methods of debris removal from a surface of a device are disclosed. An exemplary embodiment is operable to remove debris from a signal transmitting/receiving surface. An embodiment provides power to, and then removes power from, a conductive memory wire that is secured to a moveable portion of a two-position snap spring. In response to providing the power to the conductive memory wire, a length of the conductive memory wire decreases so that the moveable portion of the two-position snap spring is pulled from an extended position to a retracted position. When power is removed from the conductive memory wire, the moveable portion of the two-position snap spring moves from the retracted position to the extended position. In response to the moving of the moveable portion of the two-position snap spring from the retracted position to the extended position, an energy is generated and transferred to the surface that dislodges the debris from the surface.

BRIEF DESCRIPTION OF THE DRAWINGS

Preferred and alternative embodiments are described in detail below with reference to the following drawings.

DETAILED DESCRIPTION

Figure 1:
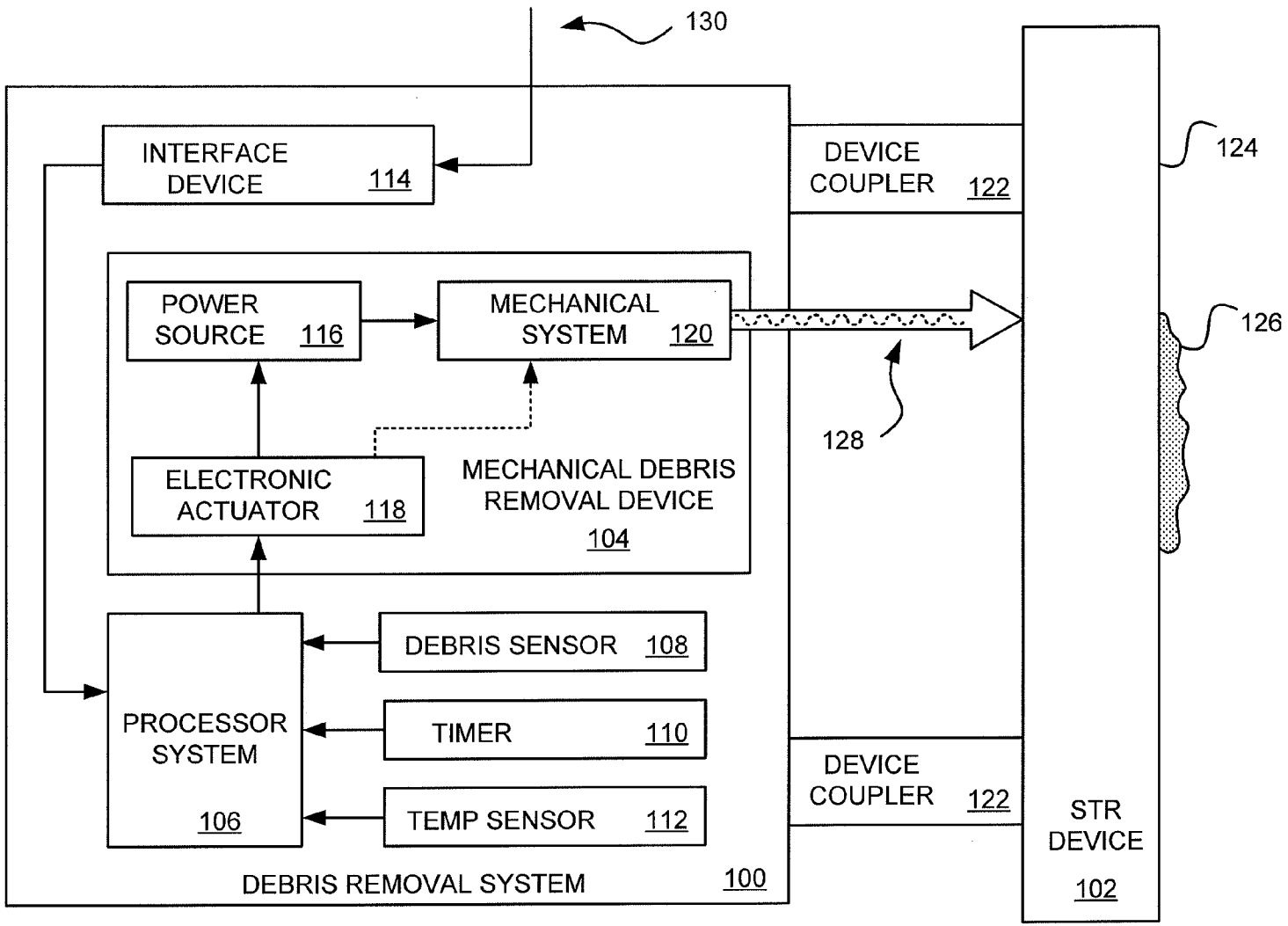
FIG. 1 is a block diagram of an embodiment of a surface debris removal system.

FIG. 1 is a block diagram of an embodiment of a surface debris removal system 100 implemented coupled to a signal transmitting/receiving (STR) device 102. Embodiments of the surface debris removal system 100 comprise a mechanical debris removal device 104, a processor system 106, an optional debris sensor 108, an optional timer 110, an optional temperature sensor 112, and an optional interface device 114. The mechanical debris removal device 104 comprises a power source 116, an electronic actuator 118, and a mechanical system 120. The surface debris removal system 100 is physically coupled to the STR device 102 using one or more device couplers 122.

The STR device 102 includes at least one signal transmitting/receiving (STR) surface 124 that accumulates undesirable debris 126. Contact surface forces between the STR surface 124 and the debris 126 allow the debris 126 to accumulate and adhere to the STR surface 124. For example, frictional forces may permit dust or snow to accumulate and adhere to the STR surface 124. If liquids are associated with the debris 126, such as when snow initially comes into contact with a relatively warm STR surface 124 and melts, surface tension may allow the formed water to adhere to the STR surface 124. At some point, the water may freeze and adhere to the STR surface 124, thus allowing additional snow to accumulate on the STR surface 124. The various forces and physical phenomena that allow debris 126 to accumulate and adhere to the STR surface 124 are generally referred to herein as contact surface forces.

When the debris 126 is to be removed, the processor system 106 communicates a control signal to the electronic actuator 118. The control signal is generated in response to some particular event which is associated with accumulation of the debris 126 on the STR surface 124.

In an exemplary embodiment, the electronic actuator 118 actuates the power source 116 so that electrical power is provided to the mechanical system 120. In other embodiments, the electronic actuator 118 directly actuates the mechanical system 120. Upon actuation, the mechanical system 120 imparts physical energy 128 to the STR device 102. The physical energy 128 may be directly imparted to the STR device 102 by the mechanical system 120, or may be transmitted to the STR device 102 via the one or more device couplers 122.

The physical energy 128 causes a shaking motion, a vibration, or the like, on the STR surface 124 such that the debris 126 falls from the STR surface 124. That is, the imparted physical energy 128 causes a movement of the STR surface 124 that is sufficient to cause gravity to overcome the contact surface forces that hold the debris 126 on the STR surface 124.

In some embodiments, the power source 116 may be a self-contained source of power, such as a battery, a solar cell, a wind generator, or combination thereof. In other embodiments, the power source 116 may be a switch device or the like that is coupled to an external source of power.

Some embodiments employ the debris sensor 108 to detect accumulation of the debris 126 on the STR surface 124. In response to detecting a threshold amount of debris 126, the debris sensor 108 communicates a signal to the processor system 106. In response to receiving a signal from the debris sensor 108, the processor system 106 generates the control signal that actuates the electronic actuator 118. The debris sensor 108 may be any suitable sensor that is configured to sense the presence of the debris 126 on the STR surface 124. Non-limiting examples of the debris sensor 108 include, but are not limited to, an optical sensor, a weight sensor, a sonic sensor, and/or a pressure sensor. Multiple debris sensors 108 may be used in some embodiments.

Some embodiments employ the timer 110 to periodically communicate a signal to the processor system 106. In response to receiving a signal from the timer 110, the processor system 106 generates the control signal that actuates the electronic actuator 118. The timer 110 may be any suitable timer device that is configured to periodically communicate a signal to the processor system 106. In some embodiments, the timer 110 may be integrated into the processor system 106.

Some embodiments employ the temperature (temp) sensor 112 to detect a temperature of the STR device 102, a temperature of the STR surface 124, an ambient temperature, and/or another temperature of interest. In response to detecting a threshold temperature, the temperature sensor 112 communicates a signal to the processor system 106. In response to receiving a signal from the temperature sensor 112, the processor system 106 generates the control signal that actuates the electronic actuator 118. The temperature sensor 112 may be any suitable temperature sensor. Multiple temperature sensors 112 may be used in some embodiments.

Some embodiments employ the interface device 114. The interface device 114 is configured to receive a signal on connection 130 that is generated by another device (not shown). In response to receiving a signal on the connection 130, the interface device 114 communicates a signal to the processor system 106. In response to receiving a signal from the interface device 114, the processor system 106 generates the control signal that actuates the electronic actuator 118. Alternatively, the interface device 114 may receive a wireless signal from the external device, such as an infrared signal or a radio frequency (RF) signal.

The interface device 114 may be any suitable interface that is configured to receive a signal from another device. For example, an external sensor (not shown) that is configured to detect accumulation of the debris 126 on the STR surface 124, detect temperature, or sense another parameter, may communicate the signal to the interface device 114. Multiple interface devices 114 may be used in some embodiments.

The interface device 114 may be communicatively coupled to a set top box (STB) or other consumer appliance that is configured to communicate the signal to the interface device 114. In some embodiments, the STB or other consumer appliance is configured to communicate the signal to the interface device 114 in response to a command from a user.

For example, the user may be watching programming on their television during a snow storm. At some point, an accumulation of snow on the STR surface 124 may interfere with signal reception. The user may then cause the STB to communicate the signal to the interface device 114 so as to dislodge the snow from the STR surface 124.

Alternatively, or additionally, the STB may be communicatively coupled to a service center or the like where an operator, service technician, or other person may cause the STB or other consumer appliance to communicate the signal to the interface device 114. For example, the user may call into the service center to complain of bad signal reception on their television. The service technician can then remotely operate the STB or other consumer appliance to communicate the signal to the interface device 114 so as to dislodge any accumulated debris 126. If the debris 126 was the cause of the poor signal reception, the user and/or the service technician would then see a noticeable improvement in the signal reception.

Alternatively, or additionally, the interface device 114 may be configured to receive the signal from a hand-held remote that is controlled by the user. For example, a special actuator, button, or the like may reside on the hand-held remote. In response to actuation by the user, the hand-held remote communicates a wireless signal to the interface device 114.

Some embodiments may employ one or more of the debris sensor 108, the timer 110, the temperature sensor 112, and/or the interface device 114. Further, one or more of the debris sensor 108, the timer 110, the temperature sensor 112, and/or the interface device 114 may reside externally to the debris removal system 100 as a separate component.

Figure 2A:
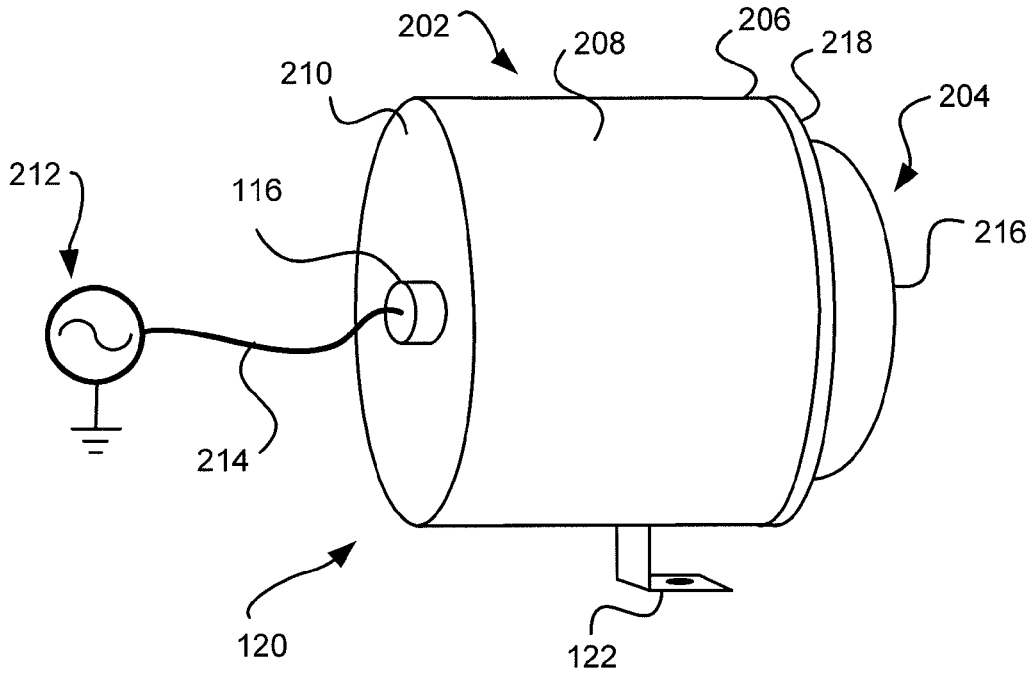
FIGS. 2A and 2B are perspective views of an exemplary embodiment of the mechanical system.
Figure 2B:
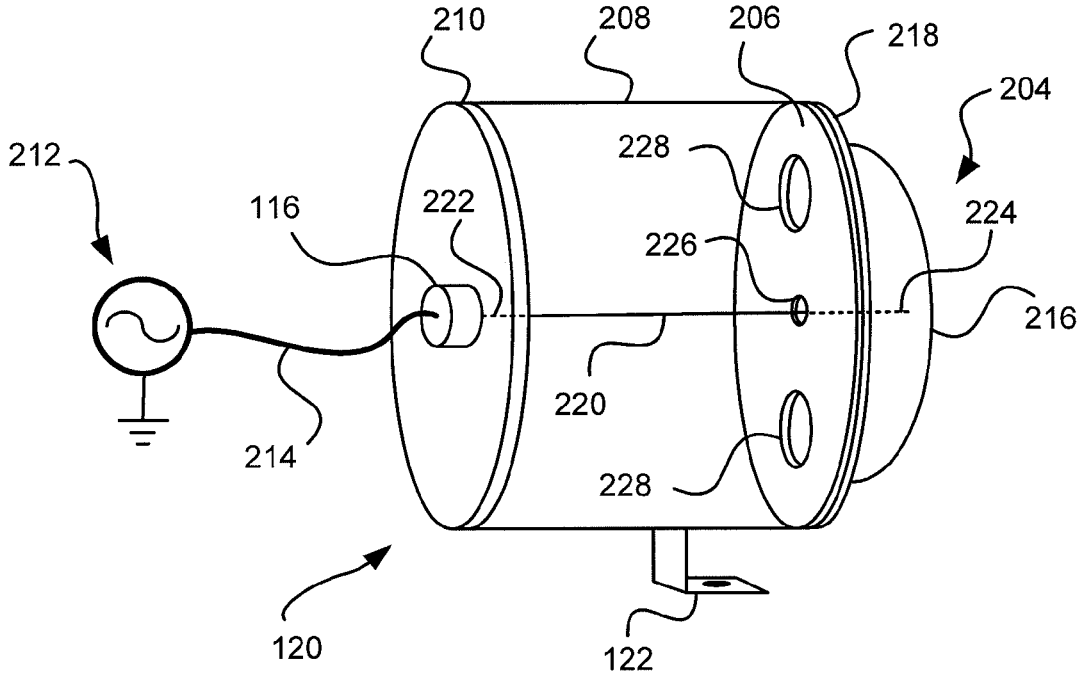

FIGS. 2A and 2B are perspective views of an exemplary embodiment of mechanical system 120. FIG. 2A shows an exterior view of the exemplary embodiment of the mechanical system 120. FIG. 2B shows an interior view of selected elements of the exemplary embodiment of the mechanical system 120. The exemplary embodiment of the surface mechanical system 120 includes a body portion 202 and a two-position snap spring 204.

The body portion 202 includes a first end portion 206, a hollow middle portion 208, and a second end portion 210. In this exemplary embodiment, the two-position snap spring 204 is secured to the first end portion 206. The power source 116 is a switch or other suitable electronic actuator that is coupled to a source of power 212 via connection 214. The power source 116 is secured to body portion 202, such as at the second end portion 210. The device coupler 122 is also secured to the body portions, such as the middle portion 208.

The two-position snap spring 204 comprises a moveable portion 216 and a securing portion 218. The securing portion 218 is secured to the first end portion 206 of the body portion 202. In this exemplary embodiment, the two-position snap spring 204 is a generally conic structure, or cup-shaped structure, made of an elastically deformable material, such as metal or plastic. The conic structure of the two-position snap spring 204 permits the moveable portion 216 of the two-position snap spring 204 to be in an extended position, as illustrated in FIGS. 2A and 2B, and in a retracted position.

The mechanical system 120 is illustrated as generally cylindrical in shape. In other embodiments, the mechanical system 120 may have other designed shapes. Further, the first end portion 206, the hollow middle portion 208, and/or the second end portion 210 may have other shapes. The mechanical system 120 may be made of any suitable material that is substantially rigid, such as metal, plastic, or the like.

FIG. 2B illustrates a conductive memory wire 220 extending through the body portion 202 of the mechanical system 120. A first end portion 222 of the conductive memory wire 220 is secured to the second end portion 210 of the body portion 202. Further, the first end portion 222 of the conductive memory wire 220 is electrically coupled to the power source 116. A second end portion 224 of the conductive memory wire 220 is secured to the moveable portion 216 of the two-position snap spring 204.

In the illustrated exemplary embodiment, the first end portion 206 is a disk with an aperture for passage of the conductive memory wire 220 there through. Thus, movement of the conductive memory wire 220 is not inhibited by the first end portion 206. One or more optional apertures 226 may be provided for the transfer of air between the two-position snap spring 204 and the body portion 202. In alternative embodiments, the first end portion 206 may be formed as a rigid ring or other structure.

Figure 3A:
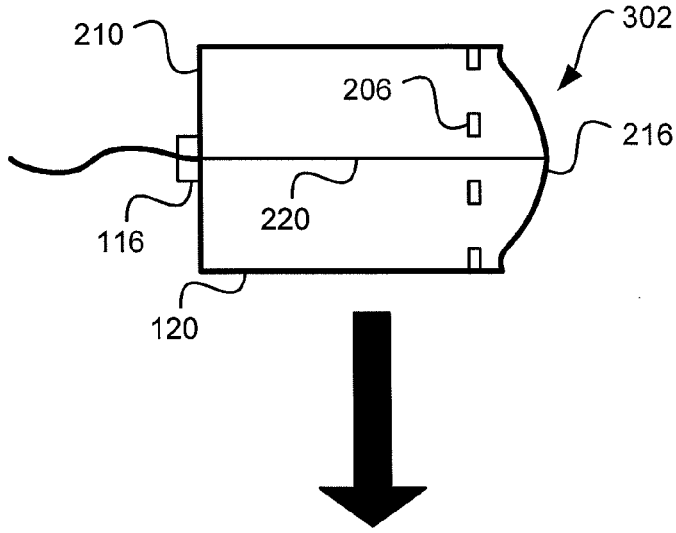
FIGS. 3A-3C illustrate a moveable portion of a two-position snap spring in an extended position and in a retracted position.
Figure 3B:
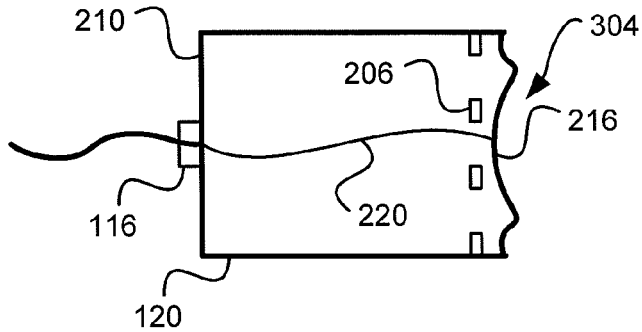
Figure 3C:
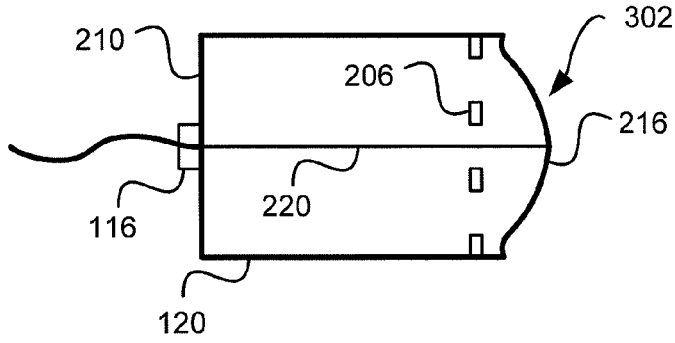

FIGS. 3A-3C illustrate the moveable portion 216 of the two-position snap spring 204 in the extended position 302 and in the refracted position 304. Initially, the moveable portion 216 of the two-position snap spring 204 is in the extended position 302. The conductive memory wire 220 is at or near an ambient temperature, and is in an elongated state.

The conductive memory wire 220 is made of a conductive material that shrinks as it is heated. Here, when current passes through the conductive memory wire 220 upon actuation of the power source 116, resistive losses caused by current passing through the conductive memory wire 220 heats the conductive memory wire 220. As the temperature of the conductive memory wire 220 increases, the length of the conductive memory wire 220 tends to decrease as the material of the conductive memory wire 220 shrinks.

Initially, since the conductive memory wire 220 is secured to the moveable portion 216 of the two-position snap spring 204, the tension of conductive memory wire 220 induced by shrinkage of the heating material begins to exert a pulling force on the moveable portion 216 of the two-position snap spring 204. At some point, the tension of the conductive memory wire 220 causes the moveable portion 216 to elastically, and rapidly, deform from the extended position 302, illustrated in FIG. 3A, to the retracted position 304, illustrated in FIG. 3B.

The moveable portion 216 of the two-position snap spring 204 tends to rapidly move from the extended position 302 to the retracted position 304 with a snap-like action. That is, very little physical displacement of the moveable portion 216 is required to cause the moveable portion 216 of the two-position snap spring 204 to snap from the extended position 302, as illustrated in FIG. 3A, to the retracted position 304, as illustrated in FIG. 3B. In the exemplary embodiment illustrated in FIG. 3B, the conductive memory wire 220 flexes to accommodate movement of the moveable portion 216 of the two-position snap spring 204 from the extended position 302 to the retracted position 304.

The power provided to the conductive memory wire 220 is terminated by a second actuation of the power source 116. With the removal of the current passing through the conductive memory wire 220, the conductive memory wire 220 begins to cool. This cooling of the conductive memory wire 220 tends to cause the material of the conductive memory wire 220 to expand. The expanding material of the conductive memory wire 220 tents to elongate the conductive memory wire 220. The elongation of the conductive memory wire 220 tends to cause a pushing force that is exerted on the moveable portion 216 of the two-position snap spring 204. At some point, the exerted force causes the moveable portion 216 of the two-position snap spring 204 to elastically, and rapidly, deform from the retracted position 304, as illustrated in FIG. 3B, to the extended position 302, as illustrated in FIG. 3C. This movement of the moveable portion 216 from the retracted position 304 to the extended position 302 occurs in a rapid, snap-like manner.

Figure 4:
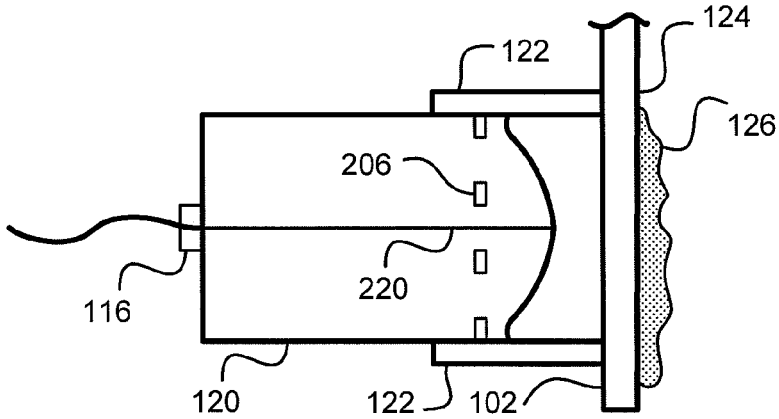
FIG. 4 illustrates an exemplary vibration-based embodiment of the surface debris removal system coupled to the STR device using one or more device couplers.

FIG. 4 illustrates a vibration-based embodiment of the surface debris removal system 100 coupled to the STR device 102 using one or more device couplers 122. The snap-like action of the moveable portion 216 of the two-position snap spring 204 from the extended position 302 to the retracted position 304 induces a motion of the mechanical system 120. Repeated application power to the conductive memory wire 220 causes the moveable portion 216 of the two-position snap spring 204 to repeatedly move between the extended position 302 and the retracted position 304, thereby inducing a vibratory motion of the mechanical system 120. Vibratory motion is caused by the inertia of the moveable portion 216 of the two-position snap spring 204 as it moves with a snap-like motion between the extended position 302 and the retracted position 304. In some embodiments, mass may be added to the moveable portion 216 of the two-position snap spring 204. The energy of the induced vibratory motion of the mechanical system 120 is transferred, via the one or more device couplers 122, to the STR device 102 such that the accumulated debris 126 is dislodged from the STR surface 124.

Figure 5:
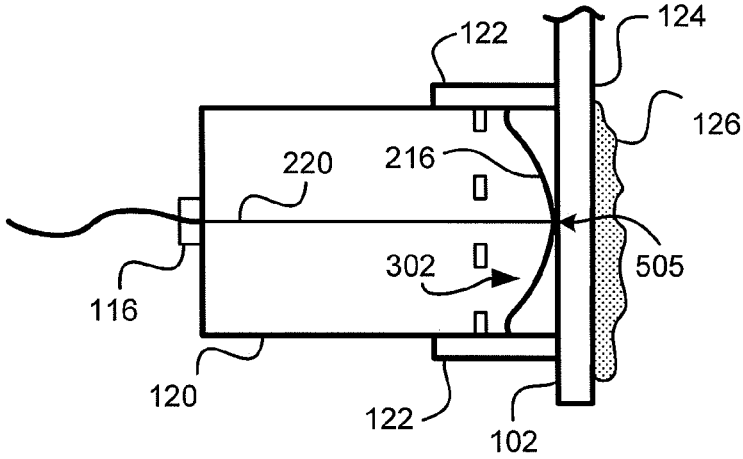
FIG. 5 illustrates an impact-based embodiment of the surface debris removal system coupled to the STR device using one or more device couplers.

FIG. 5 illustrates an impact-based embodiment of the surface debris removal system 100 coupled to the STR device 102 using one or more device couplers 122. The moveable portion 216 of the two-position snap spring 204 comes into physical contact with the STR device 102 at a selected impact point 502 when the moveable portion 216 is in the extended position 302. The location of the impact point is a design choice, and the amount of impact, is controlled by location and/or orientation of the one or more device couplers 122.

The snap-like action of the moveable portion 216 as it moves from the retracted position 304 to the extended position 302 results in an abrupt, physical impact-type contact at the impact point 502. The impact at the impact point 502 induces a transfer of energy from the mechanical system 120 to the STR device 102 due to the inertia of the moveable portion 216 as it moves with the snap-like motion from the retracted position 304 to the extended position 302. The induced impact energy to the STR device 102 causes the accumulated debris 126 to be dislodged from the STR surface 124. In some embodiments, mass may be added to the moveable portion 216 of the two-position snap spring 204 to increase the impact energy.

Figure 6:
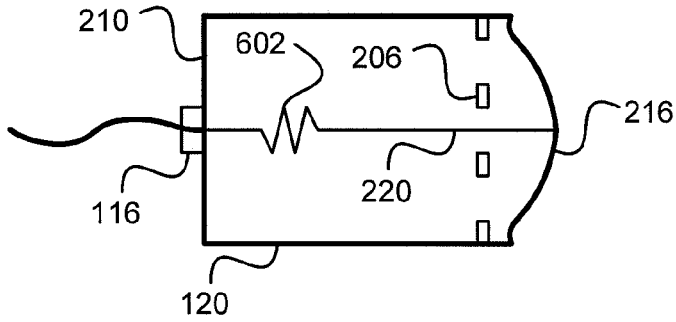
FIG. 6 illustrates an embodiment with a spring element in series with a portion of the conductive memory wire.

FIG. 6 illustrates an embodiment with a spring element 602 in series with a portion of the conductive memory wire 220. The spring element 602 may optionally be electrically conductive.

When the moveable portion 216 of the two-position snap spring 204 snaps from the retracted position 304 to the extended position 302, the spring element 602 allows continued movement of the moveable portion 216 of the two-position snap spring 204 beyond the linear extent of the conductive memory wire 220. Thus, the linear extent of the conductive memory wire 220 does not limit the movement of the moveable portion 216 of the two-position snap spring 204 when it snaps from the retracted position 304 to the extended position 302.

When power is applied to the conductive memory wire 220 to cause the moveable portion 216 of the two-position snap spring 204 to move from the extended position 302 to the retracted position 304, the spring element 602 may optionally maintain the conductive memory wire 220 in a straight line orientation, thereby avoiding bending of the conductive memory wire 220.

Figure 7:
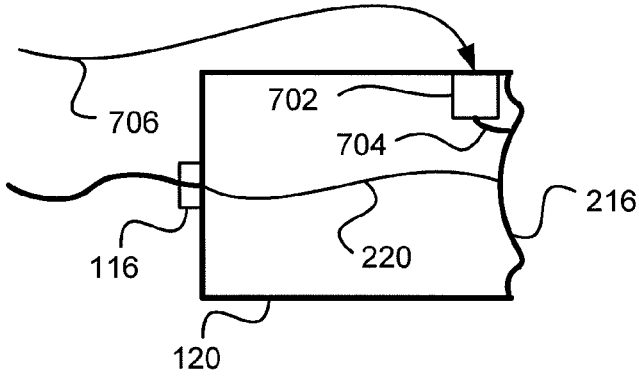
FIG. 7 illustrates an embodiment with a mechanical actuator that causes the moveable portion of the two-position snap spring to snap from the retracted position to the extended position.

FIG. 7 illustrates an embodiment with a mechanical actuator 702 that causes the moveable portion 216 of the two-position snap spring 204 to snap from the retracted position 304 to the extended position 302. The mechanical actuator 702 moves a lever arm 704 in response to receiving a control signal from the processor system 106 (FIG. 1) via connection 706. In this embodiment, the lever arm 704 engages the moveable portion 216 of the two-position snap spring 204 to move from the extended position 302 to the retracted position 304.

In this embodiment, the removal of power to the conductive memory wire 220 causes the expansion of the material of the cooling conductive memory wire 220. However, the expanding material of the conductive memory wire 220 does not generate sufficient force to initiate the snapping of the moveable portion 216 of the two-position snap spring 204 from the retracted position 304 to the extended position 302. Accordingly, at some desired time, the mechanical actuator 702 is actuated such that the lever arm 704 engages and pushes the moveable portion 216 of the two-position snap spring 204, wherein the moveable portion 216 snaps from the refracted position 304 to the extended position 302.

In some embodiments, the debris removal system 100 may reside in, or be integrated with, another electronic device. For example, the debris removal system 100 may reside in or be integrated as a component of the STB or other consumer appliance.

It should be emphasized that the above-described embodiments of the debris removal system 100 are merely possible examples of implementations of the invention. Many variations and modifications may be made to the above-described embodiments. All such modifications and variations are intended to be included herein within the scope of this disclosure and protected by the following claims.

The invention claimed is:

1. A method for debris removal from a surface, the method comprising:

providing power to a conductive memory wire that is secured to a moveable portion of a two-position snap spring, where in response to providing the power to the conductive memory wire, a length of the conductive memory wire decreases, and where in response to the decreasing length of the conductive memory wire, the moveable portion of the two-position snap spring is pulled from an extended position to a retracted position; and removing power from the conductive memory wire, where in response to removing the power to the conductive memory wire, the moveable portion of the two-position snap spring moves from the retracted position to the extended position, and where in response to the moving of the moveable portion of the two-position snap spring from the retracted position to the extended position, an energy is generated and transferred to the surface that dislodges the debris from the surface.

2. The method of claim 1, wherein a heating of a material of the conductive memory wire when the power is provided causes a shrinking of the material, and wherein the shrinking of the material reduces the length of the conductive memory wire.

3. The method of claim 1, wherein a cooling of a material of the conductive memory wire when the power is not provided causes an expansion of the material, and wherein the expansion of the material increases the length of the conductive memory wire.

4. The method of claim 1, further comprising:

actuating an actuator to engage a lever arm to push the moveable portion of the two-position snap spring, wherein the lever arm pushes the moveable portion of the two-position snap spring from the retracted position to the extended position.

5. The method of claim 1, further comprising:

repeatedly providing and removing the power, where in response to repeatedly providing and removing the power, the moveable portion of the two-position snap spring repeatedly moves between the retracted position and the extended position, thereby generating a vibratory energy that is transferred to the surface that dislodges the debris.

6. The method of claim 1, wherein the surface further comprises a surface of a signal transmitting/receiving (STR) device, and the method further comprising:

impacting said surface with the moveable portion of the two-position snap spring, and where in response to the impact of the moveable portion of the two-position snap spring on the STR device, an impact energy is generated that is transferred to the surface that dislodges the debris from the surface of the STR device.

7. The method of claim 1, further comprising:

sensing an accumulation of the debris on the surface, where in response to sensing the accumulation of the debris on the surface, the power is provided and removed from the conductive memory wire.

8. The method of claim 1, further comprising:

periodically generating a signal from a timer, where in response to generating the signal from the timer, the power is provided and removed from the conductive memory wire.

9. The method of claim 1, further comprising:

receiving a signal at an interface device, where in response to receiving the signal at the interface device, the power is provided and removed from the conductive memory wire.

10. The method of claim 3, wherein increasing the length of the conductive memory wire pushes the moveable portion of the two-position snap spring from the retracted position to the extended position.

11. The method of claim 9, wherein the signal is generated at a set top box.

12. The method of claim 9, wherein the signal is generated at a remote device.

13. The method of claim 9, wherein the signal is generated at a service center.

* * * * *